US005345148A

United States Patent [19]

Zeng et al.

[11] Patent Number: 5,345,148

[45] Date of Patent: Sep. 6, 1994

[54] DC-AC CONVERTER FOR IGNITING AND SUPPLYING A GAS DISCHARGE LAMP

[75] Inventors: Xiaming Zeng; Che L. Chia, both of Singapore, Singapore

[73] Assignee: Singapore Institute of Standards and Industrial Research, Singapore

[21] Appl. No.: 18,952

[22] Filed: Feb. 17, 1993

[30] Foreign Application Priority Data

Feb. 18, 1992 [GB] United Kingdom ..... 9203391

[51] Int. Cl.[5] ..... H05B 37/02

[52] U.S. Cl. ..... 315/209 R; 315/224

[58] Field of Search ..... 315/209 R, 212, 241 R, 315/244, 291, 224, 307, DIG. 4, DIG. 5, DIG. 7

[56] References Cited

U.S. PATENT DOCUMENTS

| | | | |
|---|---|---|---|
| 4,388,562 | 6/1983 | Josephson . | |
| 4,412,156 | 10/1983 | Ota . | |
| 4,471,422 | 9/1984 | Hierholzer, Jr. . | |
| 4,562,383 | 12/1985 | Kerscher et al. . | |
| 4,588,924 | 5/1986 | Luursema et al. . | |
| 4,682,084 | 7/1987 | Kuhnel et al. . | |
| 4,734,828 | 3/1988 | Vargo . | |
| 4,748,383 | 5/1988 | Houkes | 315/248 |
| 4,751,398 | 6/1988 | Ertz, III . | |
| 4,887,007 | 12/1989 | Almering et al. . | |
| 4,933,606 | 6/1990 | Tary . | |
| 4,935,672 | 6/1990 | Lammers et al. | 315/200 R |
| 4,937,498 | 6/1990 | Bolhuis et al. . | |
| 4,949,016 | 8/1990 | De Bijl et al. | 315/208 |
| 4,952,842 | 8/1990 | Bolhuis et al. . | |
| 4,952,845 | 8/1990 | Veldman . | |
| 4,965,493 | 10/1990 | Van Meurs et al. | 315/224 |
| 5,010,278 | 4/1991 | Kang | 315/224 |
| 5,027,038 | 6/1991 | De Bijl et al. | 315/209 R |
| 5,075,500 | 12/1991 | Overgoor et al. | 315/224 |
| 5,293,099 | 3/1994 | Bobel | 315/307 |

FOREIGN PATENT DOCUMENTS

| | | |
|---|---|---|
| 430357 | 6/1991 | European Pat. Off. . |
| 430358 | 6/1991 | European Pat. Off. . |
| 3625499 | 10/1987 | Fed. Rep. of Germany . |
| 3626209 | 2/1988 | Fed. Rep. of Germany . |
| 4014355 | 1/1991 | Fed. Rep. of Germany . |
| 2472297 | 6/1981 | France . |
| 63-64575 | 3/1988 | Japan . |
| 8102504 | 4/1981 | South Africa . |
| 603102 | 3/1978 | U.S.S.R. . |
| 750682 | 7/1980 | U.S.S.R. . |
| 2030388 | 4/1980 | United Kingdom . |
| 2072846 | 10/1981 | United Kingdom . |
| 2133940 | 8/1984 | United Kingdom . |
| 2147159 | 5/1985 | United Kingdom . |
| 2229870 | 10/1990 | United Kingdom . |

*Primary Examiner*—Richard A. Bertsch
*Assistant Examiner*—Timothy S. Thorpe
*Attorney, Agent, or Firm*—Klarquist, Sparkman Campbell Leigh & Whinston

[57] ABSTRACT

A DC-AC converter for igniting and supplying a gas discharge lamp comprises a converter control circuit including a starter circuit containing first, second and third switching elements; a load circuit including at least one gas discharge lamp; and an igniting circuit including a fourth switching element, wherein the converter control circuit controls a current through the lamp via a current sensor resistor during a pre-heating stage; the igniting circuit disenables the third switching element and thereby isolates the converter control circuit during an igniting stage; and the converter control circuit controls the current through the lamp via the current sensor resistor during normal operation.

12 Claims, 1 Drawing Sheet

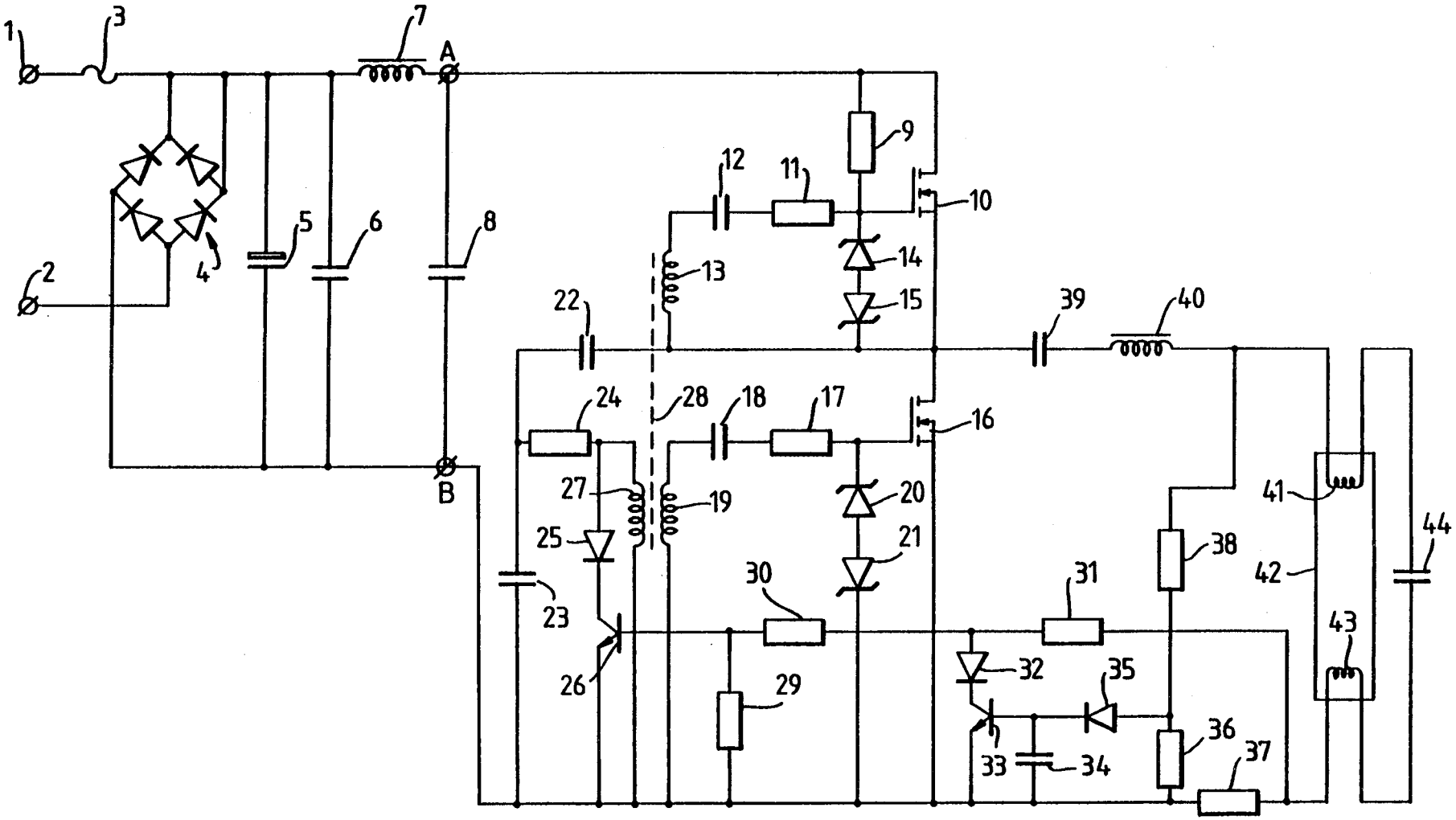
1
2
3
4
5
6
7
8
A
B
9
10
11
12
13
14
15
16
17
18
19
20
21
22
23
24
25
26
27
28
29
30
31
32
33
34
35
36
37
38
39
40
41
42
43
44

DC-AC CONVERTER FOR IGNITING AND SUPPLYING A GAS DISCHARGE LAMP

BACKGROUND OF THE INVENTION

This invention relates to a DC-AC converter for igniting and supplying a gas discharge lamp, e.g. a fluorescent lamp, the converter having two input terminals intended to be connected to a d.c. voltage source, the input terminals being connected together in series by an arrangement of at least a first semiconductor switching element, a capacitor and a load circuit comprising at least an induction coil and the gas discharge lamp. The capacitor and load circuit are shunted by a second semiconductor switching element provided with a control circuit comprising at least a starter circuit and a resonant circuit. The resonant circuit includes the parallel arrangement of the transformer primary winding and a capacitor in one branch and the gas discharge lamp in the other branch.

A DC-AC converter of this type is known from U.S. Pat. No. 4,415,838 and U.S. Pat. No. 4,748,383. The undimmed lamp situation is concerned in this case. In this known converter a transformer is present in the load circuit (in which the lamp is incorporated). This transformer has two secondary windings which form part of the control circuits of the semiconductor switching elements. The switching elements are rendered alternatively conducting and non-conducting by means of the transformer and the control circuits respectively. This known converter is designed for an electrodeless low-pressure gas discharge lamp.

However, a drawback of the known circuit is that in order to start a gas discharge lamp, e.g. a fluorescent lamp, a much higher voltage needs to be supplied to the lamp and hence the voltage across the resonant circuit which is incorporated in the series arrangement is much higher than the operating voltage. This results in a potential risk to the semiconductor switching elements. It has also been found that when the above mentioned arrangement is used for running multiple lamps with the same DC-AC converter a high current through one induction coil which is incorporated in the series arrangement with the resonant circuit and the lamps is needed to be able to supply enough power for the lamps. This is a drawback because such circuits cannot easily be used universally with lamps having different power ratings. The known circuit doesn't allow the current supplied to the lamp to be set to a predetermined value during operation of the lamp, this would offer a longer lamp life because the current through the lamp increases due to ageing, or in the case of a low pressure vapour discharge lamp, operation at a relatively hot location.

SUMMARY OF THE INVENTION

It is an object of the invention to overcome the above-mentioned problems by providing an arrangement of the type described in the opening paragraph in which the voltage across the parallel resonant circuit in the control circuit during igniting and operation is always substantially constant, and by providing a circuit which can be universally used for multiple lamps with different power ratings or for lamps whose arc current varies with age.

Accordingly, a DC-AC converter is disclosed for igniting and supplying a gas discharge lamp which comprises a converter control circuit, including a starter circuit containing first and second switching elements, and a third switching element; a load circuit including at least one gas discharge lamp; and an igniting circuit, including a fourth switching element, wherein the converter control circuit controls a current through the lamp via a current sensor resistor during a pre-heating stage; the igniting circuit disenables the third switching element and thereby isolates the converter control circuit during an igniting stage; and the converter control circuit controls the current through the lamp via the current sensor resistor during normal operation.

In a specific aspect of the present invention, there is provided a DC-AC converter for igniting and supplying a gas discharge lamp comprises: first and second input terminals for connection to a source of DC voltage; a transformer for having a primary winding, a first secondary winding and a second secondary winding; a controlled semiconductor switching element having a drain electrode, a source electrode and a control electrode; a capacitive voltage divider having first and second capacitors; first means for connecting first and second semiconductor switching elements in a first series circuit across said first and second input terminals; second means for connecting one end of a load circuit to a junction point between said first and second semiconductor switching elements and further connecting other end of said load circuit to said second terminal via a current sensor resistor, said load circuit comprising a third capacitor, an induction coil and a lamp; third means for connecting one end of said capacitive voltage divider to a junction point between said first and second semiconductor switching elements and further connecting other end of said capacitive voltage divider to said second input terminal; fourth means for connecting said second capacitor in a parallel circuit with said primary winding via a first resistor; fifth means for connecting a diode and a third semiconductor switching element across said primary winding; sixth means for connecting the one end of said current sensor resistor between a first resistive voltage divider via a fourth resistor, said first resistive voltage divider comprising a second resistor and a third resistor, and further connecting the base electrode of said third semiconductor switching element to the junction point of said first resistive voltage divider; seventh means for connecting a second resistive voltage divider across said lamp, said second resistive voltage divider comprising a fifth resistor and a sixth resistor; and eighth means for connecting a collection electrode of a fourth semiconductor switching element to one end of said first resistive divider via a second diode and connecting an emitter electrode of said fourth semiconductor element to another end of said first resistive voltage divider, and further connecting a base electrode of said fourth switching element to a junction point of said second resistive voltage divider via a third diode of a voltage rectifier, said voltage rectifier comprising a third diode and a fourth capacitor.

A control circuit of a converter embodying the present invention bypasses the high voltage peak away from the parallel resonant circuit whilst igniting the lamp thereby eliminating any risk of damaging the switching elements. The capacitor is coupled to the resonant capacitor to form the capacitive voltage divider whereby the voltage across the resonant circuit can be set by selecting the capacitor value. The capacitances of the voltage divider are chosen so that their impedances at the operating frequency of the converter are high. Preferably a value is chosen for the voltage divider at which the power dissipation in the control circuit during operation is negligible. Whilst igniting the lamp no interference signals are generated on the switching elements. The energy dissipation in the control circuit is also greatly reduced during igniting.

An embodiment of the present invention can be universally used with multiple lamps of different power ratings by connecting an additional load circuit to the converter. Therefore, the circuit can provide an easy way of lighting multiple lamps of different power ratings to one DC-AC converter. Because an induction coil of low impedance can be used, the energy dissipation in the load circuit is also greatly reduced during operation. In addition, the entire circuit of the converter based on this simple circuit can easily be integrated into the lamp base of a compact gas discharge lamp.

In an embodiment of the present invention, the converter starting circuit comprises a resistor which is connected between a drain electrode and a control electrode of a semiconductor switching element with a capacitor coupled between the control electrode and one end of a secondary winding of a transformer as described in U.S. Pat. No. 4,748,383.

According to an embodiment of the present invention, the igniting circuit comprising at least a second resistive voltage divider and a fourth semiconductor switching element is connected between the lamp and coupled to a control electrode of a third semiconductor switching element via a first resistive voltage divider. Whilst igniting the lamp a sufficiently high voltage is present across the second resistive voltage divider to allow the fourth semiconductor switching element, coupled to the second resistive voltage divider through the voltage rectifier to become conductive so as to disenable the third semiconductor switching element. As a result enough current at a relatively low frequency flows through the lamp so that the lamp can be ignited. When the lamp is ignited, the voltage across the lamp is reduced to a normal operation voltage, and the fourth semiconductor switching element becomes non-conductive so as to enable the third semiconductor switching element of the control circuit. The control circuit is now operative.

An embodiment of the present invention is based on the recognition that upon switching on the converter the capacitor arranged between the control electrode and the drain electrode of the switching element is first charged until the voltage on the control electrode is sufficiently high to render the switching element conducting. As a result a current flows to charge up the capacitor in the load circuit and a capacitive voltage divider. The parallel resonant circuit including the second capacitor of the voltage divider and the primary winding of the transformer then starts oscillating due to the current through the capacitive voltage divider. The primary winding of the transformer incorporated in the resonant circuit then takes over the driving of the semiconductor switching elements via the two secondary windings of the transformer which are connected to the control electrodes of the switching elements. The switching elements are then rendered alternatively conducting and non-conducting at the resonant frequency of the parallel resonant circuit thereby supplying the high frequency power signals for the gas discharge lamp. Meanwhile, the capacitor of the rectifier arranged between the base electrode and the emitter electrode of the fourth semiconductor switching element is now charged until the voltage on the base electrode is sufficiently high to render the fourth switching element conducting to ignite the gas discharge lamp. The third switching element is disenabled during the igniting. When the lamp is ignited, the fourth switching element becomes non-conductive due to the operating voltage of the lamp and the third switching element is enabled to activate the control circuit. The sensor resistor for measuring the current through the lamp is coupled to the third semiconductor switching element which is connected across the primary winding of the transformer in the resonant circuit to control the period of the conductance duty cycle of the first switching element on the converter. When the current through the sensor resistor reaches a threshold, the third switching element conducts, thereby reducing the conductance duty cycle of the first switching element on the converter. As a result the current through the lamp can be set to a predetermined value during operation.

The invention is particularly advantageous for use in low-pressure mercury vapour discharge lamps in which the operating current varies due to the discharge tube ageing. During operation of fluorescent lamps, an increase in the current through the lamp occurs due to a decrease of the impedance of the lamp as the lamp ages. As a result this causes the life of the fluorescent lamp to be reduced. An embodiment of the present invention makes it possible to maintain the lamp current at a constant value over the life of the lamp which can offer an extension of the lamp life.

BRIEF DESCRIPTION OF THE DRAWING

In order that the invention may be more readily understood, and so that further features thereof may be appreciated, an embodiment of the present invention will now be described with reference to the accompanying drawing which illustrates diagrammatically an embodiment of the converter according to the present invention.

DETAILED DESCRIPTION OF THE DRAWING

The supply circuit in the drawing has two input terminals 1 and 2 intended to be connected to an alternating voltage source of 220–240V, 50Hz. These terminals are connected via a fuse 3 to a full wave rectifier 4. The output voltage of this rectifier 4 is smoothed by means of a capacitor 5. Furthermore, a mains interference suppression filter constituted by a high frequency capacitor 6 and coil 7 together with the capacitor 5 is connected between the rectifier 4 and input terminals A and B of the DC-AC converter. A capacitor 8 of the supply circuit constitutes the DC voltage source for the DC-AC converter.

The converter will now be described. The terminals A and B are connected together by means of a series arrangement of a first semiconductor switching element 10 and a second semiconductor switching element 16. The switching elements are power MOS-FET type transistors.

The switching elements 10 and 16 are connected together in such a manner that the source electrode of the first switching element 10 is connected to the drain electrode of the second switching element 16.

The second semiconductor switching element 16 is shunted by means of a series arrangement of a load circuit made up of a capacitor 39, an induction coil 40, the electrodes 41 and 43 of a gas discharge lamp 42

(with capacitor 44) and a sensor resistor 37 in one branch, and a capacitive voltage divider comprising two capacitors (22, 23) in the other branch.

The second capacitor 23 of the capacitive voltage divider (22, 23) and a primary winding 27 of a current transformer 28 forms a parallel resonant circuit for a control circuit. A resistor 24 is coupled between the capacitor 23 and the primary winding 27 to optimise the phase of the drive signal for the switching elements 10 and 16. The control circuit includes a third semiconductor switching element 26 which is bridged by the primary winding 27 via a coupling diode 25. The coupling diode 25 protects the third switching element 26 from any reverse current from the primary winding 27. The current sensor resistor 37 is used to provide the feedback signal for the control circuit and is coupled to the control electrode of the third switching element 26 via a first resistive voltage divider comprising two resistors (29, 30) and a resistor 31 in which a current threshold value through the lamp 42 can be set to a predetermined value by selecting the resistance ratio of the resistors 30 and 29 in the first resistive voltage divider. The third switching element 26 controls the positive cycle of the resonant waveform of the parallel resonant circuit.

The transformer 28 has two secondary windings 13 and 19. Winding 13 forms a part of the control circuit of the first switching element 10 and is connected between the control electrode and the source electrode of the first switching element 10. The winding 13 is bridged by a voltage limiting circuit consisting of a series arrangement of two oppositely arranged Zener diodes 14 and 15 via a resistor 11 and a capacitor 12. The winding 19 forms a part of the control circuit of the second switching element 16 and is also bridged by a series arrangement of two oppositely arranged Zener diodes 20 and 21 via a resistor 17 and a capacitor 18.

A starter circuit for the converter forms a part of the control circuit of the first semiconductor switching element 10. The starter circuit includes a resistor 9 which is connected between the drain electrode and the control electrode of the first switching element 10, together with the capacitor 12 which is connected between the control electrode and one end of the secondary winding 13. This type of starter circuit is described in U.S. Pat. No. 4,748,383.

An igniting circuit for the gas discharge lamp 42 includes a second resistive voltage divider comprising two resistors 36, 38, a voltage rectifier comprising a capacitor 34 and diode 35 and a fourth semiconductor switching element 33. The second resistive voltage divider 36, 38 is connected across the lamp 42 to sense the voltage across the lamp 42. The fourth switching element 33 is bridged by the first resistive voltage divider 29, 30 via a coupling diode 32 which is used to protect the fourth switching element 33 from any reverse currents. The resistance ratio of the resistors 36, 38 in the second resistive voltage divider is chosen to render the fourth switching element 33 conducting during igniting and non-conducting during normal operation.

The converter operates as follows. If the terminals 1 and 2 are connected to the AC supply mains (e.g. 220–240V, 50Hz), the capacitors 5, 6 and 8 will be rapidly charged via the rectifier 4 up to the peak value of the AC voltage source. This results in a DC voltage being present across the input terminals A and B of the DC-AC converter. Meanwhile the capacitors 12, 22, 23 and 39 are charged via resistor 9 until the voltage across capacitor 12 reaches a threshold value at which the first semiconductor switching element 10 becomes conductive. Then a higher current flows through a series arrangement of the capacitor 39 and the load circuit (40, 41, 44, 43) as well as the current sensor resistor 37. The capacitor 23 in the parallel resonant circuit (22, 23, 27) is then quickly charged up via the first capacitor 22 of the capacitive voltage divider. An oscillation is then produced in this circuit whereafter the transformer 28 renders the first semiconductor switching element 10 non-conducting and renders the second semiconductor switching element 16 conducting. This produces a current through the capacitor 18 whereafter the second switching element 16 becomes non-conducting again and the first switching element 10 becomes conducting again and so forth.

During the igniting, the high voltage present across the lamp 42 charges up capacitor 34 of the igniting circuit via the resistor 38. Meanwhile the current through the filament electrodes 41 and 43 of the lamp 42 preheats the lamp 42 and the third switching element 26 performs the control function via the current sensor resistor 37 to control the current through the lamp 42 in a preheating stage. The current through the lamp 42 can then be maintained to the predetermined value at a relatively high operation frequency due to the relatively short conductance duty cycle of the first switching element 10. When the voltage across the capacitor 34 reaches the threshold value, the fourth switching element 33 becomes conductive and the control circuit is then disenabled. Meanwhile, the sufficiently high current and relatively low frequency power signal through the lamp 42 ignites the lamp. After the lamp has ignited, the operation voltage present across the lamp renders the fourth switching element 33 non-conducting and the control circuit is enabled. This arrangement provides the soft starting property of the converter and provides the way in which the lamp can be preheated before igniting.

If during normal operation the current through the lamp exceeds the threshold value due to the ageing of the lamp, the third switching element 26 becomes conducting to render the first switching element 10 non-conducting at an earlier stage. This arrangement provides a way of controlling the period of the conductance duty cycle of the first switching element 10, and maintains a constant current through the lamp 42 during the lamp life. This results in an extension of the lamp life.

In one embodiment of the present invention, the most important circuit elements have the values as shown in the Table below:

TABLE

| | |
|---|---|
| capacitor 12 | 0.47 uF |
| capacitor 18 | 0.47 uF |
| capacitor 22 | 220 pF |
| capacitor 23 | 680 pF |
| capacitor 39 | 0.1 uF |
| capacitor 44 | 15 nF |
| capacitor 34 | 10 uF |
| coil 40 | 500 uH |
| resistor 9 | 10 MOhm |
| resistor 11 | 10 Ohm |
| resistor 17 | 10 Ohm |
| resistor 24 | 330 Ohm |
| resistor 29 | 10 KOhm |
| resistor 30 | 5.6 KOhm |
| resistor 31 | 220 Ohm |
| resistor 36 | 10 KOhm |
| resistor 37 | 0.75 Ohm |

TABLE-continued

| | |
|---|---|
| resistor 38 | 120 KOhm |
| zener diodes 14, 20 | 12 Volts |
| zener diodes 15, 21 | 7.5 Volts |
| transformer | |
| primary winding 27 | 6.30 mH |
| secondary windings 13, 19 | 670 uH |

The gas discharge lamp 42 which is connected to the circuit specified in the above table is a fluorescent lamp having a power of 58.65 W. For a fluorescent lamp having a power of 40 W, the inductance value of the induction coil 40 and the capacitance value of the capacitor 44 would be set to 700 uH and 12 nF respectively to meet the operating condition of the lamp. The current sensor resistor 37 would need to be set to 1.5 Ohm having an operating current of 0.15 A If the DC-AC converter is used for dual lamps, the additional load circuit comprising a capacitor and an induction coil as well as the additional lamp can be connected into the circuit by means of connecting the additional load circuit between the drain electrode of the second semiconductor switching element 16 and one terminal of the current sensor resistor 37 together with the correct value of the current sensor resistor 37. The DC-AC converter described above is suitable to use with multiple lamps having different ranges of power ratings.

Having thus described an embodiment of the invention, it will now be appreciated that the objects of the invention have been fully achieved, and it will be understood by those skilled in the art that many changes in construction and widely differing embodiments and applications of the invention will suggest themselves without departing from the spirit and scope of the invention. The disclosure and the description herein are purely illustrative and are not intended to be in any sense limiting.

What is claimed is:

1. A DC-AC converter for igniting and supplying a gas discharge lamp comprises first and second input terminals for connection to a source of DC voltage; a transformer having a primary winding, a first secondary winding a second secondary winding; first, second, third and fourth controlled semiconductor switching elements each having a first electrode, a second electrode and a control electrode; a captive voltage divider having a first and a second capacitor; first means for connecting the first and second semiconductor switching elements in a first series circuit across said first and second input terminals; second means for connecting a first end of a load circuit to a junction point between the first and second semiconductor switching elements and further connecting a second end of the load circuit to the second input terminal via a current sensor resistor, the load circuit comprising a third capacitor, an induction coil and a gas discharge lamp; third means for connecting a first end of the capacitive voltage divider to a junction point between the first and second semiconductor switching elements and for connecting a second end of the capacitive voltage divider to the second input terminal; fourth means for connecting the second capacitor in a parallel circuit with the primary winding via a first resistor; fifth means for connecting a first diode and the third semiconductor switching element across the primary winding; sixth means for connecting the current sensor resistor to a first resistive voltage divider comprising a second and a third resistor via a fourth resistor, and for connecting the control electrode of the third semiconductor switching element to a junction point between the second and third resistor; seventh means for connecting a second resistive voltage divider comprising a fifth and a sixth resistor across the lamp; and eighth means for connecting the first electrode of the fourth semiconductor switching element to one end of the first resistive divider via a second diode and connecting the source electrode of the fourth semiconductor element to the other end of the first resistive voltage divider, and further connecting the control electrode of the fourth switching element to a junction point between the fifth and sixth resistors, of the second resistive voltage divider via a third diode of a voltage rectifier, the voltage rectifier comprising the third diode and a fourth capacitor.

2. A DC-AC converter according to claim 1, wherein the DC-AC converter further comprises: means for connecting a seventh resistor between the first electrode and the control electrode of the first semiconductor switching element and means for connecting a fifth capacitor and said first secondary winding in series between the control electrode and the second electrode of said first semiconductor switching element via an eighth resistor, said seventh resistor and said fifth capacitor forming a starter circuit; means for connecting a series arrangement of two oppositely arranged Zener diodes between the control electrode nd the second electrode of the first switching element to form a voltage-limiting circuit for the first switching element; means for connecting the second secondary winding between the control electrode and the second electrode of the second semiconductor switching element via a sixth capacitor and a ninth resistor; and means for connecting a series arrangement of two oppositely arranged Zener diodes between the control electrode and the second electrode of the second switching element to form a voltage-limiting circuit for the second switching element.

3. A DC-AC converter according to claim 1, wherein the seventh means and the eighth means form the igniting circuit used to enable a control circuit of the converter during igniting and to disable the control circuit after igniting.

4. A DC-AC converter according to claim 1, wherein the third and fourth means provide a second series circuit which is shunted by the first and second input terminals and includes, in series, the first semiconductor switching element, the first capacitor and the parallel circuit.

5. A DC-AC converter according to claim 1, wherein the parallel circuit forms a high frequency parallel resonant circuit that produces a high frequency oscillation current in the primary winding of the transformer when the converter is in an operating condition.

6. A DC-AC converter according to claim 1, wherein the first secondary winding and the second secondary winding provide, in response to a current in the primary winding, a switching voltage for the first and second semiconductor switching elements of a polarity which alternatively triggers the semiconductor switching elements into mutually exclusive conditions.

7. A DC-AC converter according to claim 1, wherein the capacitance of the capacitive voltage divider is chosen so that its impedance is high at the converter operating frequency.

8. A DC-AC converter according to claim 1, wherein a third series circuit is shunted by the first and second input terminals and includes, in series, the first semiconductor switching element, the load circuit and the current sensor resistor.

9. A DC-AC converter according to claim 1, wherein the current sensor resistor is coupled to the control electrode of the third semiconductor switching element via the fourth resistor and the second resistor of the first resistive voltage divider, the current through the load circuit controls the time of conductance of the third semiconductor switching element and a threshold voltage value for the third semiconductor switching element is set to a certain value by selecting the resistance of the current sensor resistor, whereby the period of the conductance duty cycle of the first semiconductor switching element, and hence the current through the lamp, can be controlled.

10. A DC-AC converter according to claim 1, wherein the current sensor resistor is coupled to the control electrode of the third semiconductor switching element via the fourth resistor and the second resistor of the first resistive voltage divider and a threshold value for the current in the lamp is set by the selection of the resistance ratio of the second and third resistors.

11. A DC-AC converter according to claim 1, wherein: the third semiconductor switching element and the first diode are connected in series across the primary winding; the parallel circuit is resonant; and whereby the positive cycle period of the resonant wave of the parallel resonant circuit can be adjusted, the first diode being used to protect the third switching element from a reverse current.

12. A DC-AC converter according to claim 1, wherein the first series circuit, a second series circuit comprising the first semiconductor switching element, the first capacitor and the parallel circuit and a third series circuit comprising the first semiconductor switching element, the load circuit and the current sensor resistor form an arrangement in which the load circuit is in one branch and the control circuit is in another branch, whereby the load circuit has a small effect on the control circuit so as to eliminate the risk to the first and second switching elements when igniting the lamp.

* * * * *

UNITED STATES PATENT AND TRADEMARK OFFICE

CERTIFICATE OF CORRECTION

PATENT NO. : 5,345,148

DATED : September 6, 1994

INVENTOR(S) : Xiaoming Zeng and Che Lock Chia

It is certified that error appears in the above-identified patent and that said Letters Patent is hereby corrected as shown below:

On the Cover of the Patent:

Inventors: "Xiaming Zeng" should be --Xiaoming Zeng--; and

References Cited: "5,075,500" should be --5,075,599--; and

Column 8, line 27: "nd" should be --and--.

Signed and Sealed this

Twenty-seventh Day of December, 1994

*Attest:*

BRUCE LEHMAN

*Attesting Officer*

*Commissioner of Patents and Trademarks*